US011472618B2

(12) United States Patent
McCree et al.

(10) Patent No.: US 11,472,618 B2
(45) Date of Patent: Oct. 18, 2022

(54) CARRIER FOR CONTAINERS

(71) Applicant: Graphic Packaging International, LLC, Atlanta, GA (US)

(72) Inventors: Justin McCree, Bristol (GB); Brian Smalley, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/231,368

(22) Filed: Apr. 15, 2021

(65) Prior Publication Data

US 2021/0229885 A1 Jul. 29, 2021

Related U.S. Application Data

(62) Division of application No. 16/426,050, filed on May 30, 2019, now Pat. No. 11,014,727.

(Continued)

(51) Int. Cl.
*B65D 71/44* (2006.01)
*B31B 50/86* (2017.01)

(Continued)

(52) U.S. Cl.
CPC ..... *B65D 71/44* (2013.01); *B31B 50/006* (2017.08); *B31B 50/04* (2017.08); *B31B 50/20* (2017.08);

(Continued)

(58) Field of Classification Search
CPC ..... B31B 50/00; B31B 50/006; B31B 50/04; B31B 50/20; B31B 50/52; B31B 50/624;

(Continued)

(56) References Cited

U.S. PATENT DOCUMENTS 1,527,399 A 2/1925 Davidson
2,289,859 A 7/1942 Arthur (Continued)

FOREIGN PATENT DOCUMENTS

AT 399701 B 7/1995
CA 2133827 10/1993

(Continued)

OTHER PUBLICATIONS

International Search Report and Written Opinion for PCT/US2019/034491 dated Sep. 19, 2019.

(Continued)

*Primary Examiner* — Bryon P Gehman
(74) *Attorney, Agent, or Firm* — Womble Bond Dickinson (US) LLP

(57) ABSTRACT

A carrier for holding a plurality of containers includes a plurality of panels, the plurality of panels includes at least one central panel and at least one attachment panel for receiving a portion of one or more containers of the plurality of containers. The at least one central panel is for being positioned between adjacent containers of the plurality of containers, and the at least one attachment panel is foldably connected to the at least one central panel. At least one divider flap is foldably connected to the at least one central panel. The at least one attachment panel is positionable between a first position and a second position. In the first position the at least one attachment panel overlies and receives a portion of one or more of the containers. In the second position the at least one attachment panel is folded relative to the at least one central panel and in an upright position to form a handle for carrying the carrier.

32 Claims, 10 Drawing Sheets

Related U.S. Application Data

(60) Provisional application No. 62/841,449, filed on May 1, 2019, provisional application No. 62/817,120, filed on Mar. 12, 2019, provisional application No. 62/814,412, filed on Mar. 6, 2019, provisional application No. 62/810,015, filed on Feb. 25, 2019, provisional application No. 62/797,585, filed on Jan. 28, 2019, provisional application No. 62/796,830, filed on Jan. 25, 2019, provisional application No. 62/783,752, filed on Dec. 21, 2018, provisional application No. 62/779,689, filed on Dec. 14, 2018.

(51) Int. Cl.

| | |
|---|---|
| ***B31B 50/20*** | (2017.01) |
| ***B31B 50/62*** | (2017.01) |
| ***B31B 50/73*** | (2017.01) |
| ***B31B 50/00*** | (2017.01) |
| ***B31B 50/04*** | (2017.01) |
| ***B31B 50/52*** | (2017.01) |

(52) U.S. Cl.
CPC ..... *B31B 50/52* (2017.08); *B31B 50/624* (2017.08); *B31B 50/734* (2017.08); *B31B 50/86* (2017.08)

(58) Field of Classification Search
CPC ..... B31B 50/734; B31B 50/86; B65D 71/40; B65D 71/42; B65D 71/44
USPC ..... 206/141, 142, 143, 163, 165; 294/87.2
See application file for complete search history.

(56) References Cited

U.S. PATENT DOCUMENTS

| | | | |
|---|---|---|---|
| 2,320,440 | A | 6/1943 | Kruea |
| 2,331,038 | A | 10/1943 | Meller |
| 2,397,376 | A | 3/1946 | Caldwell |
| 2,397,716 | A | 4/1946 | Wendler |
| 2,522,950 | A | 9/1950 | Keith |
| 2,594,376 | A | 4/1952 | Ameson |
| 2,594,377 | A | 4/1952 | Ameson |
| 2,737,326 | A | 3/1956 | Toensmeier |
| 2,798,603 | A | 7/1957 | Grinspoon |
| 2,950,041 | A | 8/1960 | Stone |
| 2,965,410 | A | 12/1960 | Hughes |
| 3,001,647 | A | 9/1961 | Liss |
| 3,046,711 | A | 7/1962 | Harrison |
| 3,061,141 | A | 10/1962 | Cote |
| 3,094,210 | A | 6/1963 | Van Der Berg |
| 3,099,475 | A | 7/1963 | Manizza |
| 3,118,537 | A | 1/1964 | Copping |
| 3,128,034 | A | 4/1964 | Weiss |
| 3,137,109 | A | 6/1964 | Rapata |
| 3,146,885 | A | 9/1964 | Grantham |
| 3,156,358 | A | 11/1964 | Randrup |
| 3,200,944 | A | 8/1965 | Rapata |
| 3,223,308 | A | 12/1965 | Weiss |
| 3,245,711 | A | 4/1966 | Dantoin |
| 3,257,066 | A | 6/1966 | Williams |
| 3,281,180 | A | 10/1966 | Spery |
| 3,302,784 | A | 2/1967 | Copping |
| 3,387,879 | A | 6/1968 | Wood |
| 3,410,596 | A | 11/1968 | Slevin, Jr. |
| 3,432,202 | A | 3/1969 | Ebelhardt |
| 3,463,535 | A | 8/1969 | Beart |
| 3,528,697 | A | 9/1970 | Wood |
| 3,587,847 | A | 6/1971 | Graser |
| 3,601,439 | A | 8/1971 | Poupitch |
| 3,612,266 | A | 10/1971 | Graser |
| D222,579 | S | 11/1971 | Oglesbee |
| 3,627,121 | A | 12/1971 | Deasy |
| 3,653,503 | A | 4/1972 | Arneson |
| 3,693,787 | A | 9/1972 | Duerr |
| 3,698,550 | A | 10/1972 | Graser |
| 3,701,416 | A | 10/1972 | Lawrence |
| 3,722,945 | A | 3/1973 | Wood |
| 3,726,558 | A | 4/1973 | Klygis |
| 3,734,278 | A | 5/1973 | Kerrigan |
| 3,876,066 | A | 4/1975 | Klygis |
| 3,897,873 | A | 8/1975 | Graser |
| 3,924,739 | A | 12/1975 | Gravesteijn |
| 3,942,631 | A | 3/1976 | Sutherland et al. |
| 4,029,204 | A | 6/1977 | Manizza |
| 4,111,298 | A | 9/1978 | Mascia |
| 4,120,396 | A | 10/1978 | Mascia |
| 4,136,772 | A | 1/1979 | Mascia |
| 4,155,502 | A | 5/1979 | Forte |
| 4,190,149 | A | 2/1980 | Oliff et al. |
| D257,001 | S | 9/1980 | Oliff |
| 4,244,617 | A | 1/1981 | Manizza |
| 4,304,329 | A | 12/1981 | Graser |
| D265,292 | S | 7/1982 | Killy |
| 4,339,032 | A | 7/1982 | Wood |
| 4,372,599 | A | 2/1983 | Kiedaisch et al. |
| 4,378,879 | A | 4/1983 | Killy |
| 4,382,505 | A | 5/1983 | Sutherland et al. |
| 4,441,611 | A | 4/1984 | Sommariva |
| 4,471,870 | A | 9/1984 | Uhlig |
| 4,523,676 | A | 6/1985 | Barrash |
| 4,784,266 | A | 11/1988 | Chaussadas |
| D304,017 | S | 10/1989 | Oliff |
| 4,911,288 | A | 3/1990 | Dantoin, Jr. |
| 4,974,726 | A | 12/1990 | Klygis et al. |
| 5,002,225 | A | 3/1991 | Bienaime |
| 5,065,862 | A | 11/1991 | Mousseau |
| 5,103,971 | A | 4/1992 | Schuster |
| 5,125,506 | A | 6/1992 | Galbierz et al. |
| 5,135,104 | A | 8/1992 | Jorba |
| 5,139,147 | A | 8/1992 | Sutherland |
| 5,188,225 | A | 2/1993 | Jorba |
| 5,193,673 | A | 3/1993 | Rathbone et al. |
| 5,201,412 | A | 4/1993 | Schuster et al. |
| 5,230,425 | A | 7/1993 | Edqvist et al. |
| 5,246,113 | A | 9/1993 | Schuster |
| 5,263,299 | A | 11/1993 | Galbierz et al. |
| 5,267,644 | A | 12/1993 | Tsao |
| 5,282,348 | A | 2/1994 | Dampier et al. |
| 5,297,673 | A | 3/1994 | Sutherland |
| 5,310,050 | A | 5/1994 | Sutherland |
| 5,310,051 | A | 5/1994 | Sutherland |
| 5,314,224 | A | 5/1994 | Bates |
| 5,318,178 | A | 6/1994 | Davies et al. |
| 5,323,895 | A | 6/1994 | Sutherland et al. |
| 5,328,024 | A | 7/1994 | Sutherland |
| 5,335,774 | A | 8/1994 | Ganz |
| 5,351,815 | A | 10/1994 | Fogle et al. |
| 5,351,816 | A | 10/1994 | Sutherland et al. |
| 5,351,817 | A | 10/1994 | Sutherland |
| 5,355,999 | A | 10/1994 | Sutherland |
| 5,360,104 | A | 11/1994 | Sutherland |
| 5,390,784 | A | 2/1995 | Sutherland |
| 5,407,065 | A | 4/1995 | Sutherland |
| 5,415,278 | A | 5/1995 | Sutherland |
| 5,443,153 | A | 8/1995 | Sutherland |
| 5,445,262 | A | 8/1995 | Sutherland |
| 5,452,799 | A | 9/1995 | Sutherland |
| 5,484,053 | A | 1/1996 | Harris |
| 5,485,914 | A | 1/1996 | Martin |
| 5,487,464 | A | 1/1996 | Galbierz et al. |
| 5,490,593 | A | 2/1996 | Gordon et al. |
| 5,503,267 | A | 4/1996 | Sutherland |
| 5,520,283 | A | 5/1996 | Sutherland |
| 5,524,756 | A | 6/1996 | Sutherland |
| 5,551,566 | A | 9/1996 | Sutherland |
| 5,553,704 | A | 9/1996 | Gordon et al. |
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |
| 5,609,379 | A | 3/1997 | Harrelson |

(56) References Cited

U.S. PATENT DOCUMENTS

| | | | |
|---|---|---|---|
| 5,682,982 | A | 11/1997 | Stonehouse |
| 5,706,936 | A | 1/1998 | Bernstein |
| 5,711,419 | A | 1/1998 | Beales et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,096,413 | B2 | 1/2012 | Coltri De Paula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| 10,836,550 | B2 | 11/2020 | Zacherle |
| D920,809 | S | 6/2021 | Chesnet et al. |
| 11,027,905 | B2 | 6/2021 | Ford |
| 11,180,301 | B2 | 11/2021 | Smalley |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |

FOREIGN PATENT DOCUMENTS

| | | | |
|---|---|---|---|
| DE | 298 13 672 | U1 | 11/1998 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| FR | 2 737 196 | A1 | 1/1997 |
| GB | 1 256 684 | | 12/1971 |
| GB | 2 321 229 | A | 7/1998 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| KR | 10-2005-0051616 | A | 6/2005 |
| KR | 10-2020-0106806 | A | 9/2020 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2008/058294 | A1 | 5/2008 |
| WO | WO 2010/006629 | A1 | 1/2010 |
| WO | WO 2010/101852 | A1 | 9/2010 |

OTHER PUBLICATIONS

International Search Report and Written Opinion for PCT/US2019/034490 dated Sep. 19, 2019.

International Search Report and Written Opinion for PCT/US2019/034494 dated Sep. 19, 2019.

International Search Report and Written Opinion for PCT/US2019/034489 dated Sep. 19, 2019.

International Search Report and Written Opinion for PCT/US2019/034493 dated Sep. 20, 2019.

International Search Report and Written Opinion for PCT/US2020/024614 dated Sep. 15, 2020.

European Search Report for EP 19 18 0439 dated Jan. 10, 2020.

European Search Report for EP 19 18 0460 dated Jan. 13, 2020.

European Search Report for EP 19 18 0436 dated Jan. 22, 2020.

European Search Report for EP 19 18 0446 dated Feb. 3, 2020.

European Search Report for EP 19 18 0453 dated Feb. 10, 2020.

European Search Report for EP 20 16 8268 dated Oct. 2, 2020.

International Search Report and Written Opinion for PCT/US2020/054205 dated Jan. 20, 2021.

International Search Report and Written Opinion for PCT/US2020/064472 dated Mar. 15, 2021.

International Search Report and Written Opinion for PCT/US2020/064471 dated Mar. 29, 2021.

International Search Report and Written Opinion for PCT/US2020/064473 dated Apr. 1, 2021.

(56) References Cited

OTHER PUBLICATIONS

European Search Report for EP 20 20 533 dated Mar. 23, 2021.
Issue Notification for U.S. Appl. No. 16/426,050, dated May 5, 2021.
Notice of Allowability for U.S. Appl. No. 16/426,050, dated Apr. 30, 2021.
Issue Fee Transmittal Form for U.S. Appl. No. 16/426,050, dated Apr. 15, 2021.
Notice of Allowance and Fee(s) Due for U.S. Appl. No. 16/426,050, dated Mar. 17, 2021.
Amendment A and Response to Office Action for U.S. Appl. No. 16/426,050, dated Feb. 18, 2021.
Office Action for U.S. Appl. No. 16/426,050, dated Nov. 18, 2020.
Response to Election of Species for U.S. Appl. No. 16/426,050, dated Oct. 27, 2020.
Office Action for U.S. Appl. No. 16/426,050, dated Sep. 29, 2020.
U.S. Appl. No. 16/426,050, filed May 30, 2019.
U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 17/118,999, filed Dec. 11, 2020.
U.S. Appl. No. 17/119,016, filed Dec. 11, 2020.
U.S. Appl. No. 17/119,040, filed Dec. 11, 2020.
U.S. Appl. No. 16/562,957, filed Sep. 6, 2019.
U.S. Appl. No. 17/036,775, filed Sep. 29, 2020.
International Search Report and Written Opinion for PCT/US2021/052279 dated Jan. 5, 2022.
International Search Report and Written Opinion for PCT/US2021/052278 dated Jan. 5, 2022.
International Search Report and Written Opinion for PCT/US2021/052272 dated Jan. 7, 2022.
International Search Report and Written Opinion for PCT/US2021/052290 dated Jan. 21, 2022.
U.S. Appl. No. 17/478,025, filed Sep. 17, 2021.
U.S. Appl. No. 17/487,113, filed Sep. 28, 2021.
U.S. Appl. No. 17/487,131, filed Sep. 28, 2021.
U.S. Appl. No. 17/487,141, filed Sep. 28, 2021.
U.S. Appl. No. 17/487,262, filed Sep. 28, 2021.
European Search Report for EP 20 21 5364 dated Jul. 1, 2021.
European Search Report for EP 20 21 5371 dated Jul. 1, 2021.
European Search Report for EP 20 21 5399 dated Jul. 1, 2021.

CARRIER FOR CONTAINERS

CROSS-REFERENCE TO RELATED APPLICATIONS

This application is a divisional application of U.S. patent application Ser. No. 16/426,050, filed on May 30, 2019, which claims the benefit of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, and U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019.

INCORPORATION BY REFERENCE

The disclosures of each of U.S. patent application Ser. No. 16/426,050, filed on May 30, 2019, U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, and U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019, are hereby incorporated by reference for all purposes as if presented herein in their entirety.

BACKGROUND OF THE DISCLOSURE

The present disclosure generally relates to carriers or cartons for holding, displaying, and/or transporting containers.

SUMMARY OF THE DISCLOSURE

According to one aspect of the disclosure, a carrier for holding a plurality of containers comprises a plurality of panels, the plurality of panels comprising at least one central panel and at least one attachment panel for receiving a portion of one or more containers of the plurality of containers. The at least one central panel is for being positioned between adjacent containers of the plurality of containers, and the at least one attachment panel is foldably connected to the at least one central panel. At least one divider flap is foldably connected to the at least one central panel. The at least one attachment panel is positionable between a first position and a second position. In the first position the at least one attachment panel overlies and receives a portion of one or more of the containers. In the second position the at least one attachment panel is folded relative to the at least one central panel and in an upright position to form a handle for carrying the carrier.

According to another aspect of the disclosure, a blank for forming a carrier for holding a plurality of containers comprises a plurality of panels comprising at least one central panel and at least one attachment panel for receiving a portion of one or more containers of the plurality of containers. The at least one attachment panel is foldably connected to the at least one central panel, and the at least one central panel is for being positioned between adjacent containers of the plurality of containers when the carrier is formed from the blank. At least one divider flap is foldably connected to the at least one central panel. The at least one attachment panel is positionable between a first position and a second position. In the first position the at least one attachment panel overlies and receives a portion of one or more of the containers when the carrier is formed from the blank. In the second position the at least one attachment panel is folded relative to the at least one central panel and in an upright position to form a handle for carrying the carrier formed from the blank.

According to another aspect of the disclosure, a method of forming a carrier for holding a plurality of containers comprises obtaining a blank comprising a plurality of panels comprising at least one central panel and at least one attachment panel for receiving a portion of one or more containers of the plurality of containers. The at least one attachment panel is foldably connected to the at least one central panel. The blank comprises at least one divider flap foldably connected to the at least one central panel. The method further comprises positioning the at least one central panel between adjacent containers of the plurality of containers, positioning the at least one attachment panel in a first position in which the at least one attachment panel overlies and receives a portion of one or more of the containers, and positioning the at least one attachment panel in a second position in which the at least one attachment panel is folded relative to the at least one central panel and in an upright position to form a handle for carrying the carrier.

According to another aspect of the disclosure, a package comprises a plurality of containers and a carrier. The carrier comprises a plurality of panels comprising at least one central panel and at least one attachment panel receiving a portion of one or more containers of the plurality of containers. The at least one central panel is positioned between adjacent containers of the plurality of containers, and the at least one attachment panel is foldably connected to the at least one central panel. The carrier comprises at least one divider flap foldably connected to the at least one central panel. The at least one attachment panel is positionable between a first position and a second position. In the first position the at least one attachment panel overlies and receives a portion of one or more of the containers. In the second position the at least one attachment panel is folded relative to the at least one central panel and in an upright position to form a handle for carrying the package.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blanks can be designated in relative terms to one another, e.g., "first", "second", "third", etc., in sequential or non-sequential reference, without departing from the disclosure.

Figure 1:
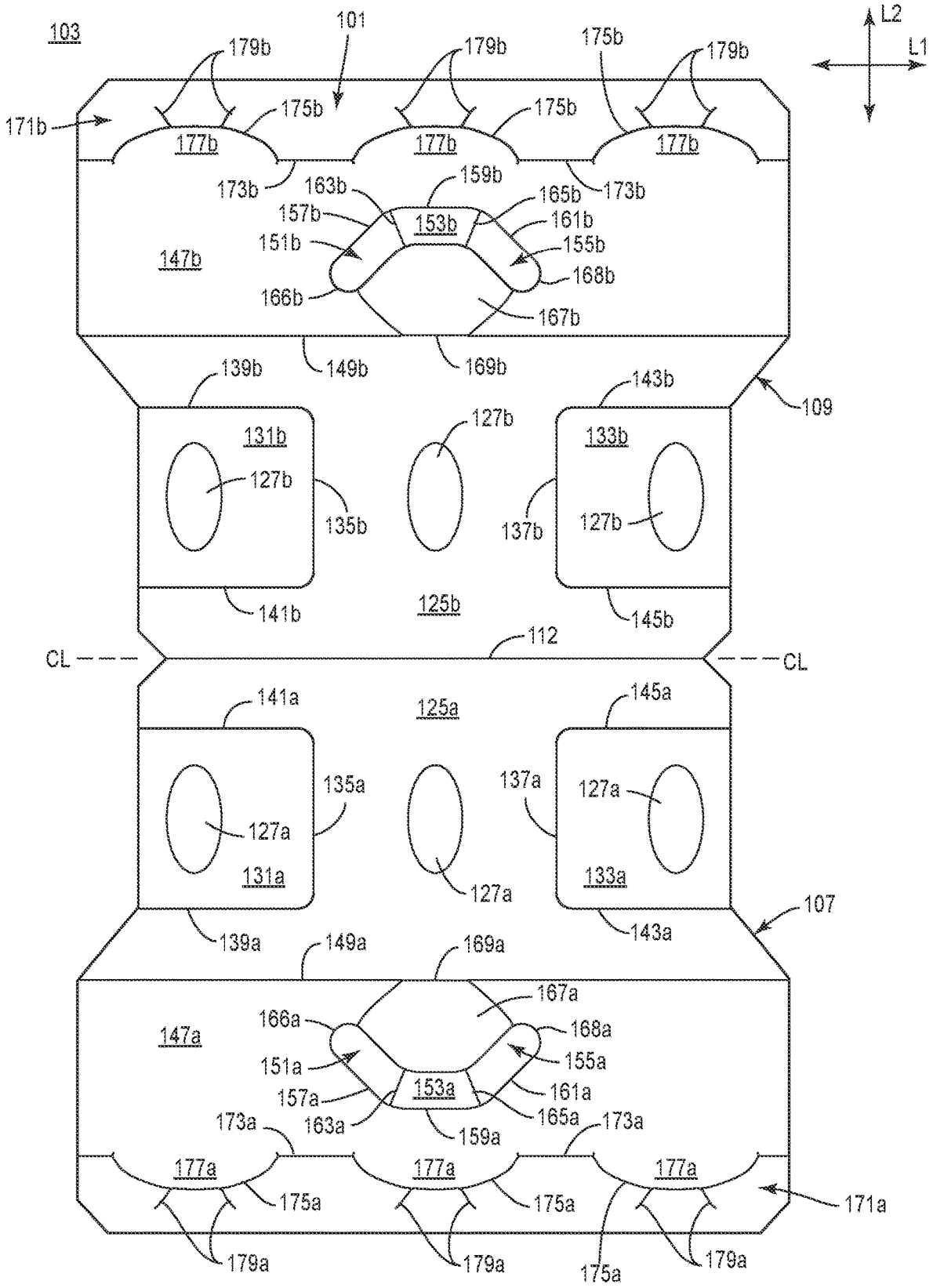
FIG. 1 is a plan view of an outer surface of a blank for forming a carrier according to a first exemplary embodiment of the disclosure.
Figure 4:
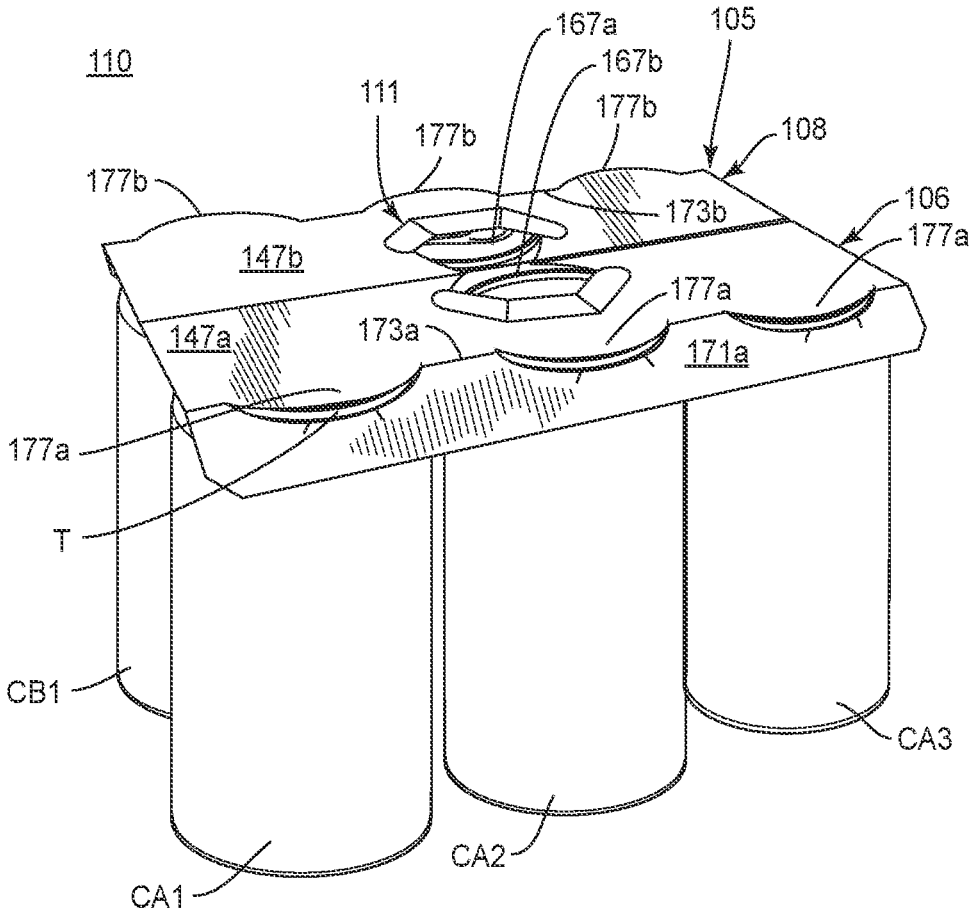
FIG. 4 is a perspective view of the package and carrier of FIG. 3 including the removed pair of containers.

FIG. 1 shows a plan view of an exterior side 101 of a blank 103 used to form a handle assembly or carrier 105 (FIG. 4) in accordance with a first exemplary embodiment of the disclosure. As shown in FIG. 4, the carrier 105 is sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 4).

As shown in FIG. 1, the blank 103 has a longitudinal axis L2 and a lateral axis L1. The blank 103 has a front portion 107 for forming the front portion 106 of the carrier 105 (FIG. 4), and a back portion 109 for forming the back portion 108 of the carrier 105 (FIG. 4). The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that one or more portions of the front portion 107 and the back portion 109 of the blank 103 are overlapped in at least partial face-to-face contact.

In the illustrated embodiment, the front portion 107 of the blank 103 comprises a front central panel 125*a* with an adhesive or glue opening 127*a* at a central portion thereof. A first front divider flap 131*a* and a second front divider flap 133*a* are foldably connected to the front central panel 125*a* at respective lateral fold lines 135*a*, 137*a*, and are defined by respective cuts 139*a*, 141*a* and 143*a*, 145*a* that extend from free edges of the front central panel 125*a* to endpoints of the respective fold lines 135*a*, 137*a*. In one embodiment, one or more of the respective cuts 139, 141*a*, 143*a*, 145*a* can include a curved portion, for example, adjacent the respective fold line 135*a*, 137*a*.

As shown, each divider flap 131*a*, 133*a* includes a glue opening 127*a* on an interior portion thereof. As shown, the glue openings 127*a* can have a similar configuration, e.g., an ovoid configuration, as shown, or one or more of the glue openings 127*a* can have a different configuration, e.g., a circular, square, triangular, rectangular, or other polygonal or closed curved profile.

A front handle panel or front attachment panel 147*a* is foldably connected to the front central panel 125*a* at a lateral top or fold line 149*a*. A plurality of handle reinforcement flaps 151*a*, 153*a*, 155*a* are foldably connected to the front attachment panel 147*a* at a respective oblique fold line 157*a*, lateral fold line 159*a*, and oblique fold line 161*a*, and extend into a handle opening 167*a* in the attachment panel 147*a*. The handle reinforcement flap 151*a* is separated from the handle reinforcement flap 153*a* at an oblique cut 163*a* and the handle reinforcement flap 153*a* is separated from the handle reinforcement flap 155*a* at an oblique cut 165*a*. Respective curved cuts 166, 168 can also be provided, for example, intersecting the respective fold lines 157*a*, 161*a* and the handle opening 167*a*, to provide for separation of the respective handle reinforcement flaps 151*a*, 155*a* from respective portions of the attachment panel 147*a*. The handle opening 167*a* extends from free edges of the handle reinforcement flaps 151*a*, 153*a*, 155*a* to the central panel 125*a* to define a free edge 169*a* of the central panel 125*a* that interrupts the fold line 149*a*.

Container receiving or attachment features in the front portion 107 of the blank 103 include a front bevel panel or front retention flap 171*a* foldably connected to the front attachment panel 147*a* at a lateral fold line 173*a* that is interrupted by curved cuts 175*a* that extend toward the front retention flap 171*a* and which define retention tabs 177*a* that protrude from the front attachment panel 147*a*. The cuts 175*a* can have one or more curved or angled portions, and one or more relief cuts 179*a* extending obliquely from one or more portions thereof into the front retention flap 171*a* to provide flexible reconfiguration of one or more portions of the attachment features of the blank 103 upon receipt of one or more container.

In the illustrated embodiment, the back portion 109 of the blank 103 includes a back central panel 125*b*, a back attachment panel 147*b*, back retention flaps 171*b*, and back divider flaps 131*b*, 133*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
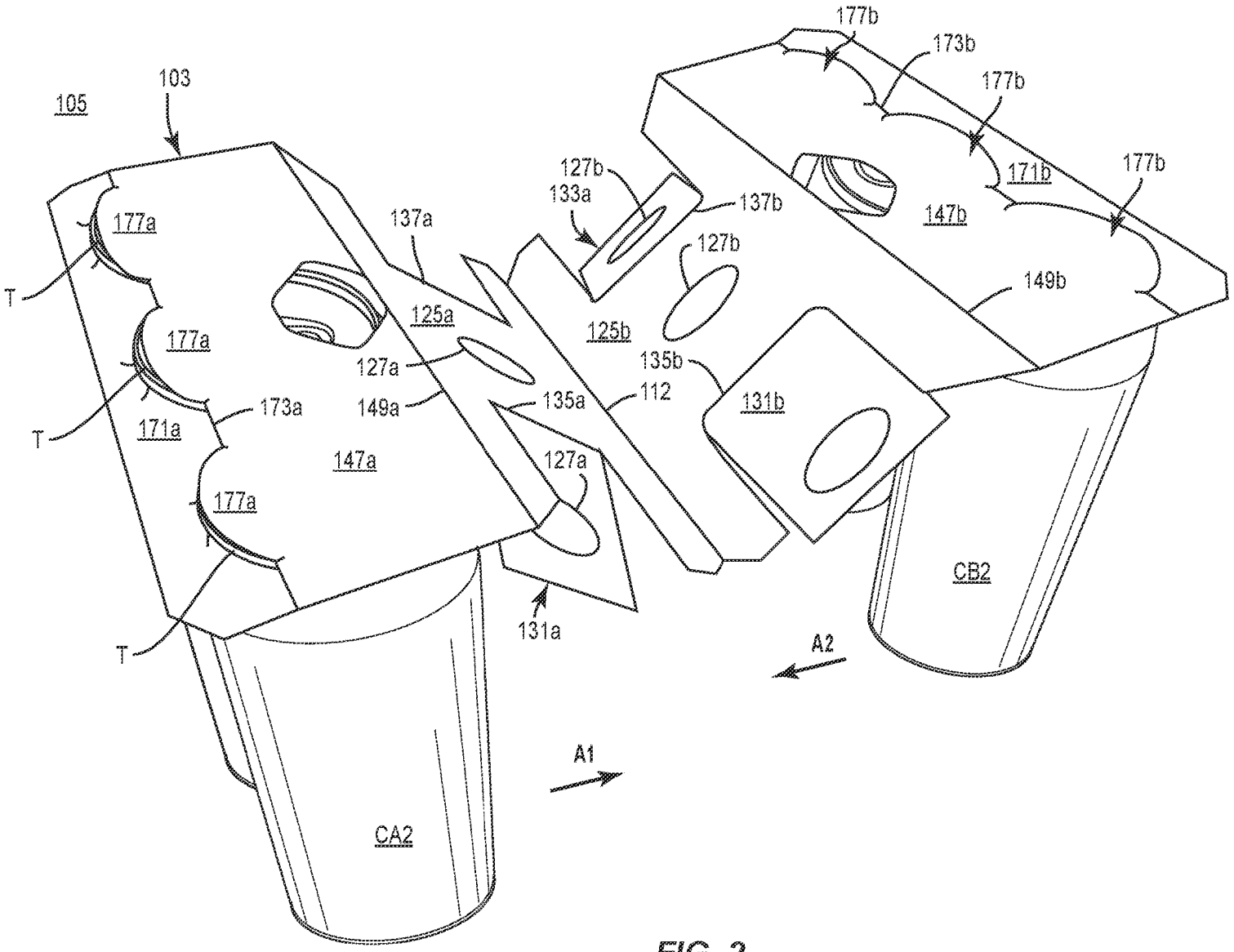
FIG. 2 is a perspective view of a partially folded configuration of a carrier formed from the blank of FIG. 1 according to the first exemplary embodiment.
Figure 3:
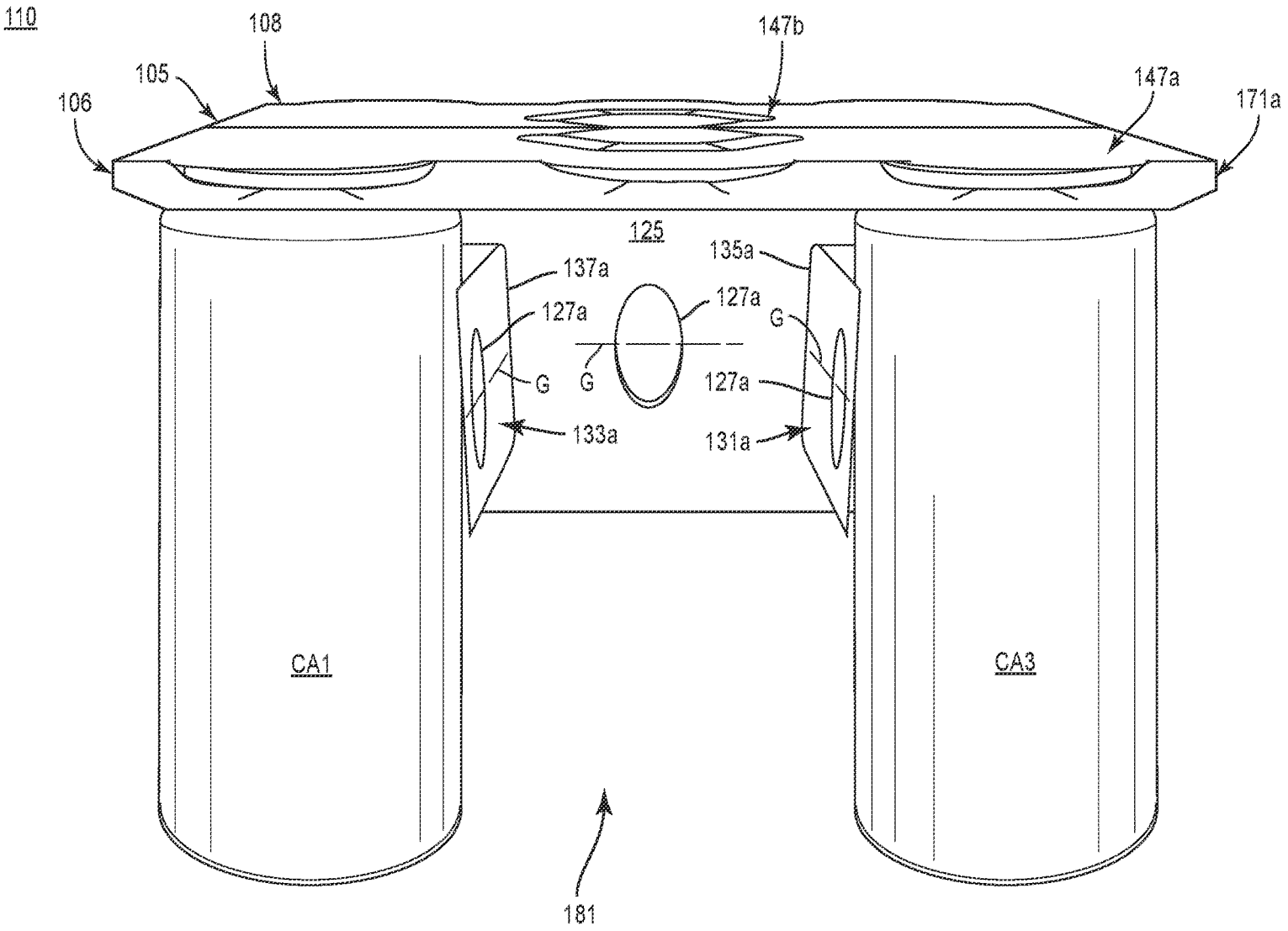
FIG. 3 is a front view of a package and carrier formed from the blank of FIG. 1 in a first configuration and having a pair of containers removed according to the first exemplary embodiment.

In one embodiment, and referring additionally to FIGS. 2 and 3, the front attachment panel 147*a* and the back attachment panel 147*b* are configured to receive a portion of one or more of the respective containers CA1, CA2, CA3 and CB1, CB2, CB3. In this regard, the exterior surface of the blank 101 at the respective front attachment panel 147*a* and back the attachment panel 147*b* can be placed over a top portion T, e.g., rims, of the respective containers CA1, CA2, CA3 and CB1, CB2, CB3, such that the top portions T of the respective containers CA1, CA2, CA3 and CB1, CB2, CB3 extend through the respective cuts 175*a*, 175*b* to be at least partially engaged by adjacent edges of the respective attachment panels 147*a*, 147*b* and the respective retention flaps 171*a*, 171*b*. In addition, the respective retention flaps 171*a*, 171*b* can be urged or otherwise folded downwardly at the respective fold lines 173*a*, 173*b* to be arranged obliquely relative to the respective attachment panels 147*a*, 147*b* such that the respective retention tabs 177*a*, 177*b* at least partially separate from the respective retention flaps 171*a*, 171*b*. In such an arrangement, the respective containers CA1, CA2, CA3, CB1, CB2, CB3 are at least partially retained between a respective retention tab 177*a*, 177*b* and a respective retention flap 171*a*, 171*b*. In one embodiment, one or more of the retention tabs 177*a*, 177*b* can engage a portion of a respective container CA1, CA2, CA3, CB1, CB2, CB3, e.g., a recessed portion of a respective top adjacent a respective container rim.

As also shown, the front attachment panel 125*a* and the back attachment panel 125*b* can be folded at the fold line 112 and the central panels 125*a*, 125*b* can be moved into at least partial face-to-face contact in the direction of the respective arrows A1, A2 and such that the glue openings 127*a*, 127*b* in the respective central panels 125*a*, 125*b* are in general alignment such that the front portion 106 of the carrier 105 and the back portion of the carrier 105 are in communication through the respective glue openings 127*a*, 127*b* in the respective central panels 125*a*, 125*b*. Such movement of the front attachment panel 125*a* and the back attachment panel 125*b* can include downward folding of the respective front attachment panel 125*a* and the back attachment panel 125*b* at the respective fold lines 149*a*, 149*b*.

As shown in FIG. 3, in which the containers CA2, CB2 are removed for clarity of illustration, the front divider flaps 131*a*, 133*a* and the back divider flaps 131*b*, 133*b* can be separated from the respective front central panel 125*a* and the back central panel 125*b* at the respective cuts 139*a*, 141*a*, 143*a*, 145*a* and 139*b*, 141*b*, 143*b*, 145*b* and folded away from the respective front central panel 125*a* and the back central panel 125*b* at the respective fold lines 135*a*, 137*a* and 135*b*, 137*b* to be positioned in a generally perpendicular and outwardly-extending arrangement relative to the respective front central panel 125*a* and the back central panel 125*b* so that the divider flaps 131*a*, 133*a* can be placed between respective adjacent containers. In this regard, container receiving spaces 181 can be defined in the front portion 106 and the back portion 108 of the carrier 105 adjacent respective divider flaps 131*a*, 131*b*, 133*a*, 133*b*. In one embodiment, respective container receiving spaces 181 can be provided for the respective containers CA1, CA2, CA3 (broadly, a respective "first container receiving space", "second container receiving space", and "third container receiving space") and the containers CB1, CB2, CB3 (broadly, a respective "first container receiving space", "second container receiving space", and "third container receiving space"). While only the containers CA1, CA3, CB1, CB3 are illustrated in FIG. 3 for clarity of illustration, it will be understood that all of the containers CA1, CA2, CA3 and CB1, CB2, CB3 can be engaged with the respective handle panels 147*a*, 147*b* as described above.

Accordingly, one or more of the containers CA1, CA2, CA3, CB1, CB2, CB3 can be loaded into the container receiving spaces 181 of the carrier 105 to form the package 110. In the illustrated carrier 105, containers CA1, CA2, and CA3 are located in the container receiving spaces 181 of the front portion 106 of the carrier 105, and containers CB1, CB2, and CB3 are located in the container receiving spaces 181 of the back portion 108 of the carrier 105. As shown in FIGS. 2 and 3, the glue openings 127*a* in the respective divider flaps 131*a*, 133*a*, 131*b*, 133*b* provide communication between adjacent container receiving spaces 181 and respective containers CA1, CA2, CA3, CB1, CB2, CB3 such that a line or other arrangement of adhesive such as glue G can be applied across the respective glue openings 127*a* and onto adjacent portions of the respective divider flaps 131*a*, 133*a*. In this regard, glue G is provided to adhere the containers CA1 and CA2 to the divider flap 133*a* and to each other through the respective glue opening 127*a* in the divider flap 133*a*, and the glue G is provided to adhere the containers CA2 and CA3 to the divider flap 131*a* and to each other through the respective glue opening 127*a* in the divider flap 131*a*. It will be understood that the containers CB1, CB2, and CB3 are adhered to each other and to the respective divider flaps 133*b*, 131*b* with lines of glue G in a substantially similar or identical manner as the containers CA1, CA2, and CA3 as described above.

Additionally, at least the centrally-disposed containers CA2 and CB2 are adhered to each other through the respective glue openings 127*a*, 127*b* in the respective front central panel 125*a* and the back central panel 125*b* with a line of glue G across the respective glue openings 127*a*, 127*b* such that every container CA1, CA2, CA3, CB1, CB2, CB3 is adhered to each other, directly or indirectly through other containers, as well as to one or more portions of the carrier 105. Such lines of glue G that adhere the containers CA2, CB2 to one another through the central glue openings 127*a* can also extend onto respective portions of the respective central panels 125*a*, 125*b* such that one or both of the containers CA2, CB2 can additionally be adhered to portions of the respective central panels 125*a*, 125*b*. It will be understood that additional lines or arrangements of adhesive can be provided among containers CA1, CA2, CA3, CB1, CB2, CB3 and/or portions of the carrier 105. For example, in one embodiment, glue G can be provided between containers CA1, CB1 or CA3, CB3 through an opening in the central panels 125*a*, 125*b* formed by the separation of a respective divider flap 133*a*, 133*b* or 131*a*, 131*b* therefrom.

The glue G described herein can be, for example, a hot melt adhesive, a high tack glue, an epoxy, a polymeric cement, etc., or combinations thereof.

As shown in FIG. 4, in a first configuration of the carrier 105, e.g., a storage and/or transport configuration of the carrier 105, the attachment panels 147*a*, 147*b* are in a first position that is folded downwardly at the respective fold lines 149*a*, 149*b* to at least partially overlie and engage the top portions T of the respective containers CA1, CA2, CA3 and CB1, CB2, CB3 so as to receive a portion therethrough, as described above.

Figure 5:
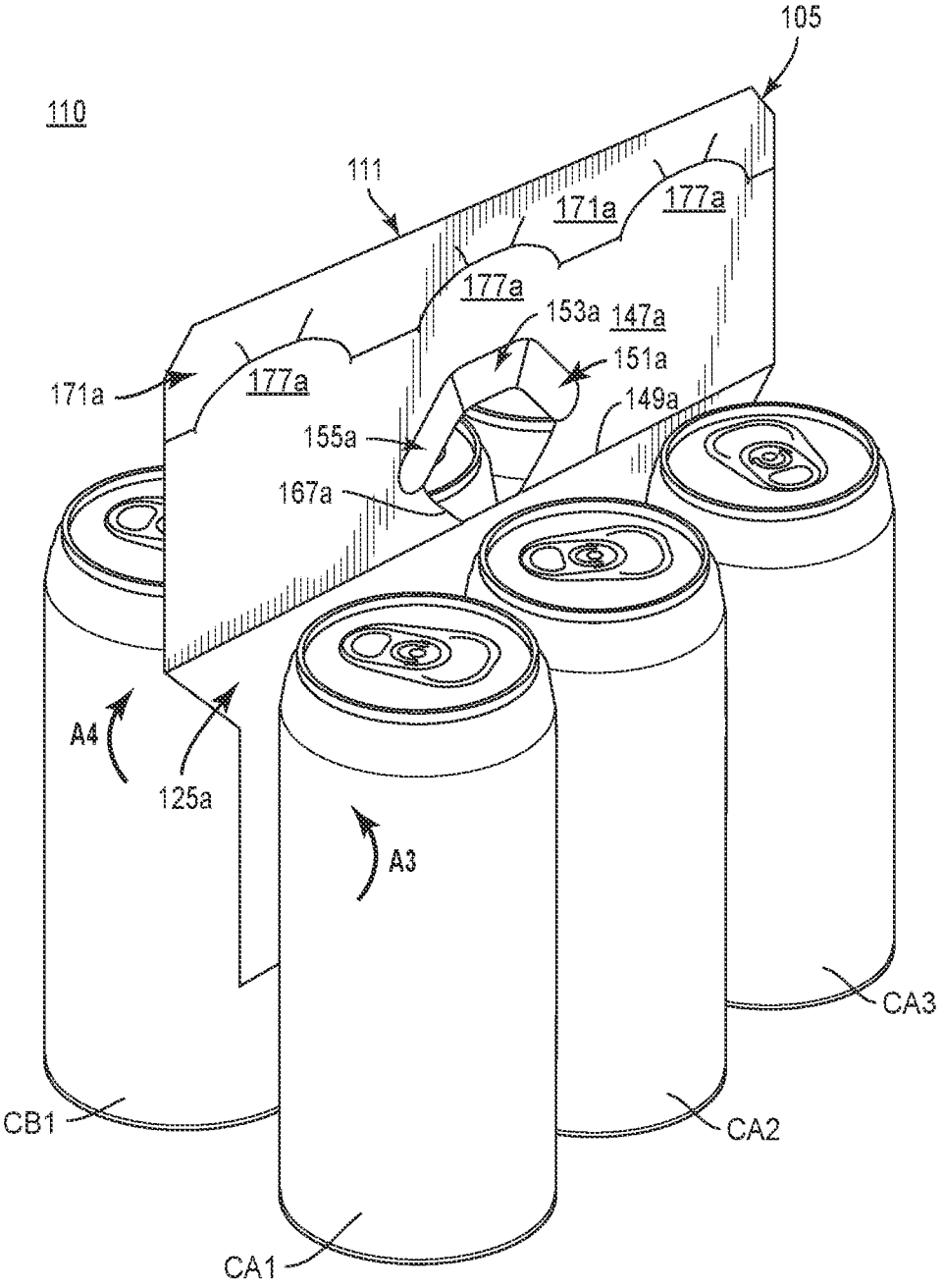
FIG. 5 is a perspective view of the package and carrier of FIG. 4 in a second configuration.

Referring additionally to FIG. 5, in a second configuration of the carrier 105, e.g., a carrying configuration of the carrier 105, the attachment panels 147*a*, 147*b* and retention flaps 171*a*, 171*b* can be disengaged or detached from the respective containers CA1, CA2, CA3, CB1, CB2, CB3 and the handle panels 147*a*, 147*b* can be folded upwardly at the respective fold lines 149*a*, 149*b* in the direction of the respective arrows A3, A4 into at least partial face-to-face or otherwise overlapping contact and such that the handle openings 167*a*, 167*b* are generally aligned. Such an upright position and arrangement of the attachment panels 147*a*, 147*b* (broadly, "second position" of the attachment panels 147*a*, 147*b*) provides a handle 111 that a customer can grasp, for example, through the handle openings 167*a*, 167*b*, to carry the package 110/carrier 105. In this regard, the attachment panels 147*a*, 147*b* are repositionable relative to the respective central panels 125*a*, 125*b* such that in the first configuration of the carrier 105, the respective attachment panels 147*a*, 147*b* are configured as attachment panels for engaging and receiving a portion of one or more of the respective containers CA1, CA2, CA3 and CB1, CB2, CB3, and in the second configuration of the carrier 105, the respective attachment panels 147*a*, 147*b* are configured as handle panels that provide the handle 111 for carrying the carrier 105.

One or more of the handle reinforcement flaps 151*a*, 153*a*, 155*a*, 151*b*, 153*b*, 155*b* can be at least partially folded at the respective fold lines 157*a*, 159*a*, 161*a*, 157*b*, 159*b*, 161*b* into at least partially overlapping relation with a respective attachment panel 147*a*, 147*b*, for example, to provide a layered structure, e.g., having a 4-ply configuration, that provides additional carrying strength and/or comfort to the customer.

The package 110 described above provides a carrier 105 with a compact structure that can, for example, provide materials savings and waste reduction. Additionally, the arrangement of the glue G among the containers CA1, CA2, CA3, CB1, CB2, CB3 as well as the divider flaps 131*a*, 131*b*, 133*a*, 133*b* and the central panels 125*a*, 125*b* provides multiple points of attachment that results in a robust structure for holding and carrying the containers CA1, CA2, CA3, CB1, CB2, CB3. Further, the exposure of one or more portions of the containers CA1, CA2, CA3, CB1, CB2, CB3 on exterior portions of the carrier 105/package 110 provides a customer with a clear view of labeling or surface graphics associated with the containers CA1, CA2, CA3, CB1, CB2, CB3 as well as providing convenient access to remove one or more of the containers CA1, CA2, CA3, CB1, CB2, CB3 from the carrier 105/package 110, for example, by peeling a respective container away from an adjacent container and/or portion of the carrier 105 to overcome the adhesion of respective glue G that adheres a respective container to a respective portion of the package 110. In one embodiment, the glue G can be selected so as to remain on a respective central panel 125*a*, 125*b* and/or respective divider flap 131*a*, 133*a*, 131*b*, 133*b*, e.g., such that substantially little or no glue G remains on the container as it is removed. One or more of the containers CA1, CA2, CA3, CB1, CB2, CB3, in one embodiment, can be reattached to a respective central panel 225*a*, 225*b* following therefrom by pressing the container against a respective region of glue G.

Figure 6:
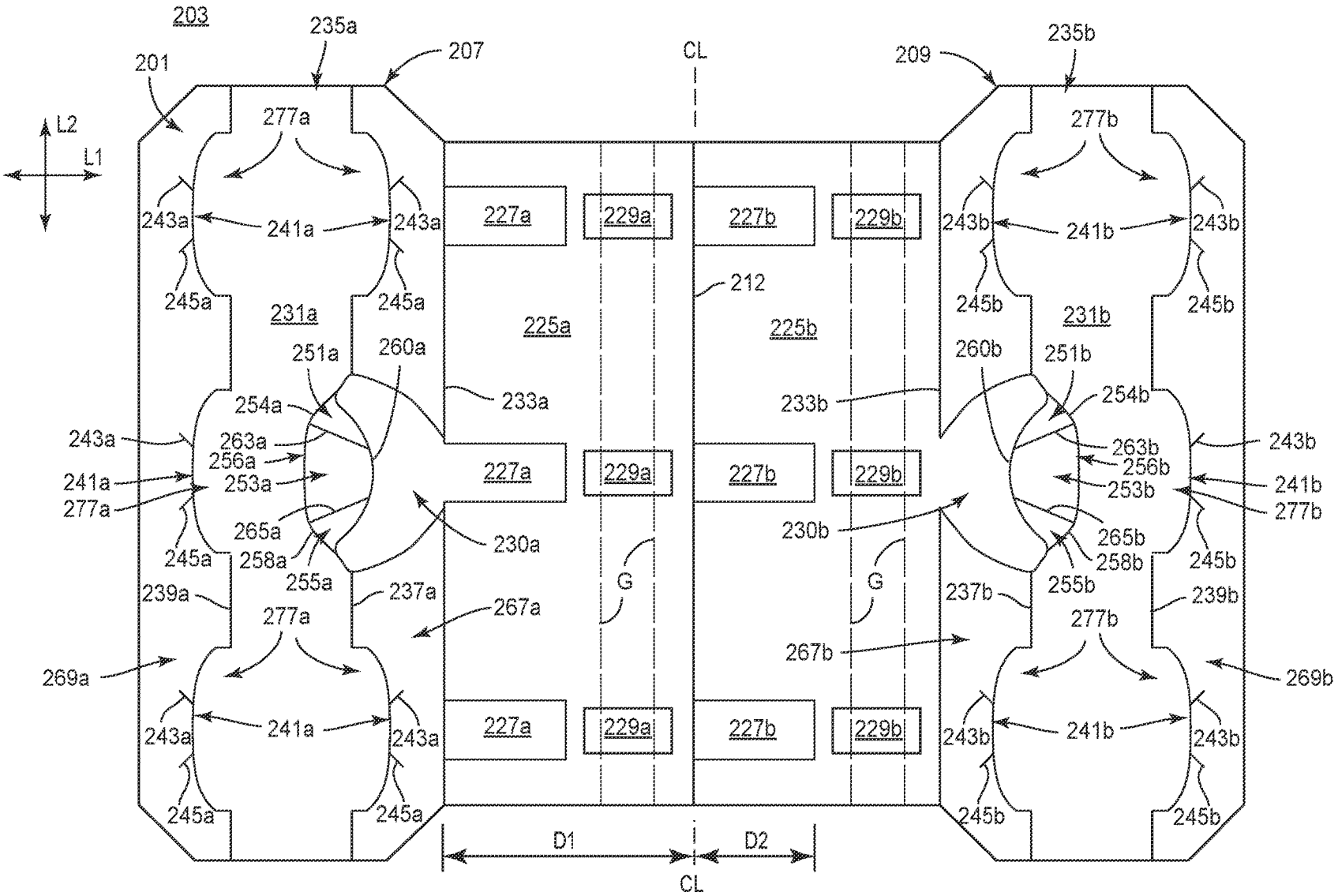
FIG. 6 is a plan view of an outer surface of a blank for forming a carrier according to a second exemplary embodiment of the disclosure.

FIG. 6 shows a plan view of an exterior side 201 of a blank 203 used to form a handle assembly or carrier 205 (FIG. 9) in accordance with a second exemplary embodiment of the disclosure. The blank 203, carrier 205, and associated package 210 including one or more containers can have one or more features that are substantially similar to those of the respective blank 103 (FIG. 1), carrier 105, and package 110 (FIG. 4) of the first exemplary embodiment of the disclosure, and like or similar reference numbers are used to designate like or similar features.

As shown in FIG. 6, the blank 203 has a longitudinal axis L1 and a lateral axis L2. The blank 203 has a front portion 207 for forming the front portion 206 of the carrier 205 (FIG. 9), and a back portion 209 for forming the back portion 208 of the carrier 205. The front portion 207 and the back portion 209 of the blank 203 are foldably connected at a lateral fold line 212 that forms a lateral centerline CL of the blank 203, as shown. As discussed in further detail below, the blank 203 is partially formed into the carrier 205 by folding the blank 203 at the fold line 212 along the centerline CL so that the front portion 207 and the back portion 209 of the blank 203 are overlapped in at least partial face-to-face contact.

In the illustrated embodiment, the front portion 207 of the blank 203 comprises a front central panel 225*a* having a pair of adhesive or glue openings 227*a* at interior portions thereof and a pair of surface features 229*a* adjacent the respective glue openings 227*a*. The surface features 229*a* can be, for example, an embossed feature or other at least partially raised or recessed surface configuration. As shown, the top edges of the respective glue openings 227*a* are spaced a longitudinal distance D1 away from the centerline CL that is greater than a longitudinal distance D2 that the top edges of respective glue openings 227*b* of the back portion 209 of the blank 203 are spaced away from the centerline CL. As also described further herein, the central glue opening 227*a* intersects a handle opening 230*a* that extends into the attachment panel 231*a* such that the central glue opening 227*a* and the handle opening 230*a* are in communication with one another.

A front handle panel or front attachment panel 231*a* is foldably connected to the front central panel 225*a* at a lateral fold line 233*a* that is interrupted by the top edges of the respective glue openings 227*a* and/or a portion of the handle opening 230*a*. The front attachment panel 231*a* includes a container retention portion 235*a* that is at least partially defined between a pair of longitudinally-spaced lateral fold lines 237*a*, 239*a* (broadly, "second fold line" and "first fold line", respectively. As shown, the lateral fold line 239*a* is interrupted by a set of three longitudinally-spaced cuts 241*a* that can each include one or more curved and/or angled portions, and the lateral fold line 237*a* is interrupted by a pair of the longitudinally-spaced cuts 241*a* that are opposite the respective longitudinally outermost cuts 241*a* that interrupt the fold line 239*a*. Respective oblique cuts 243*a*, 245*a* extend outwardly from each respective cut 241*a* to permit flexible reconfiguration of one or more portions of the attachment panel 231*a* upon receipt of one or more container. As shown, an interior marginal portion 267*a* of the attachment panel 231*a* is defined between the fold lines 237*a*, 233*a*, and the fold line 239*a* defines a front bevel panel or front retention flap or an exterior marginal portion 269*a* of the attachment panel 231*a*. In this regard, the longitudinally-spaced cuts 241*a* extend toward respective portions of the interior marginal portion 267*a* and the front retention flap or exterior marginal portion 269*a*, and define respective retention tabs 277*a* extending from the container retention portion 235*a*.

As also shown, the blank 203 includes handle features that include a plurality of handle reinforcement flaps 251*a*, 253*a*, 255*a* that are foldably connected to the attachment panel 231*a* at a respective oblique fold line 254*a*, a lateral fold line 256*a*, and an oblique fold line 258*a*, and which extend into the handle opening 230*a*. The handle reinforcement flap 251*a* is separated from the handle reinforcement flap 253*a* at an oblique cut 263*a*, and the handle reinforcement flap 253*a* is separated from the handle reinforcement flap 255*a* at an oblique cut 265*a*. In the illustrated embodiment, free edges of the handle reinforcement flaps 251*a*, 253*a*, 255*a* form a curved edge 260*a* that is adjacent the handle opening 230*a*.

In the illustrated embodiment, the back portion 209 of the blank 203 includes a back central panel 225*b* and a back handle panel or back attachment panel 231*b* having associated features that are generally a mirror-image of the corresponding panels and flaps of the front portion 207 of the blank 203. Corresponding components (e.g., panels, flaps, fold lines, cuts, etc.) have been designated by corresponding reference numbers that differ by the "a" or "b" suffix, with the "a" components corresponding to the front portion 207 of the blank 203 and the "b" components corresponding to the back portion 209 of the blank 203.

As also shown, glue G can be applied to one or more portions of the central panels 225*a*, 225*b*, e.g., across the respective surface features 229*a*, 229*b*. While the glue G is illustrated on the exterior surface 201 of the blank 203 in FIG. 6, it will be understood that the glue G can be applied to both the interior surface and the exterior surface of the central panels 225*a*, 225*b* without departing from the disclosure.

Any of the panels, flaps, fold lines, cuts, or other features could be otherwise shaped, arranged, and/or omitted from the blank 203 without departing from the disclosure. The blank 203 could be sized and/or shaped to accommodate more or less than six containers without departing from this disclosure.

Figure 7:
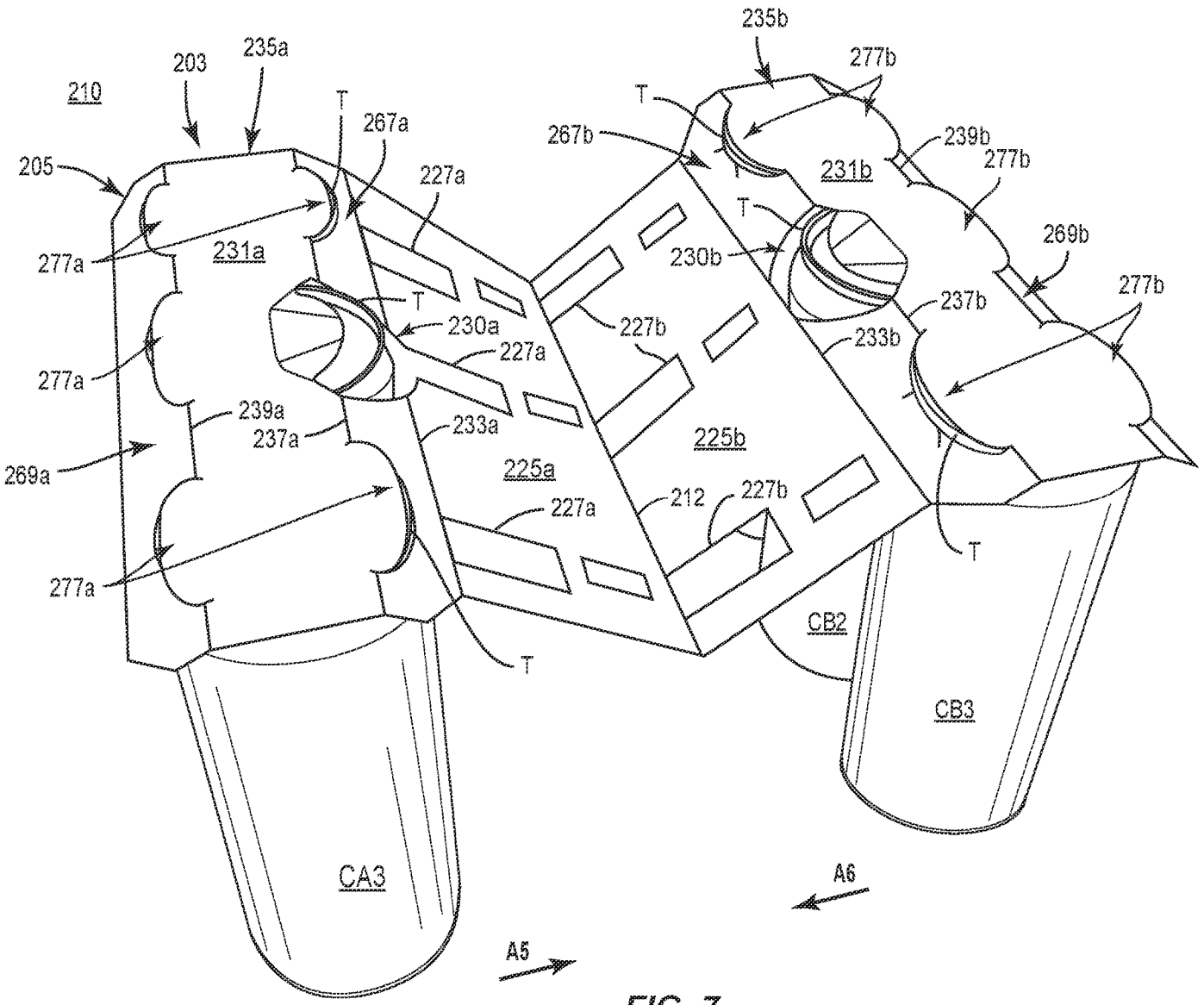
FIG. 7 is a perspective view of a partially folded configuration of a carrier formed from the blank of FIG. 6 according to the first exemplary embodiment.
Figure 8:
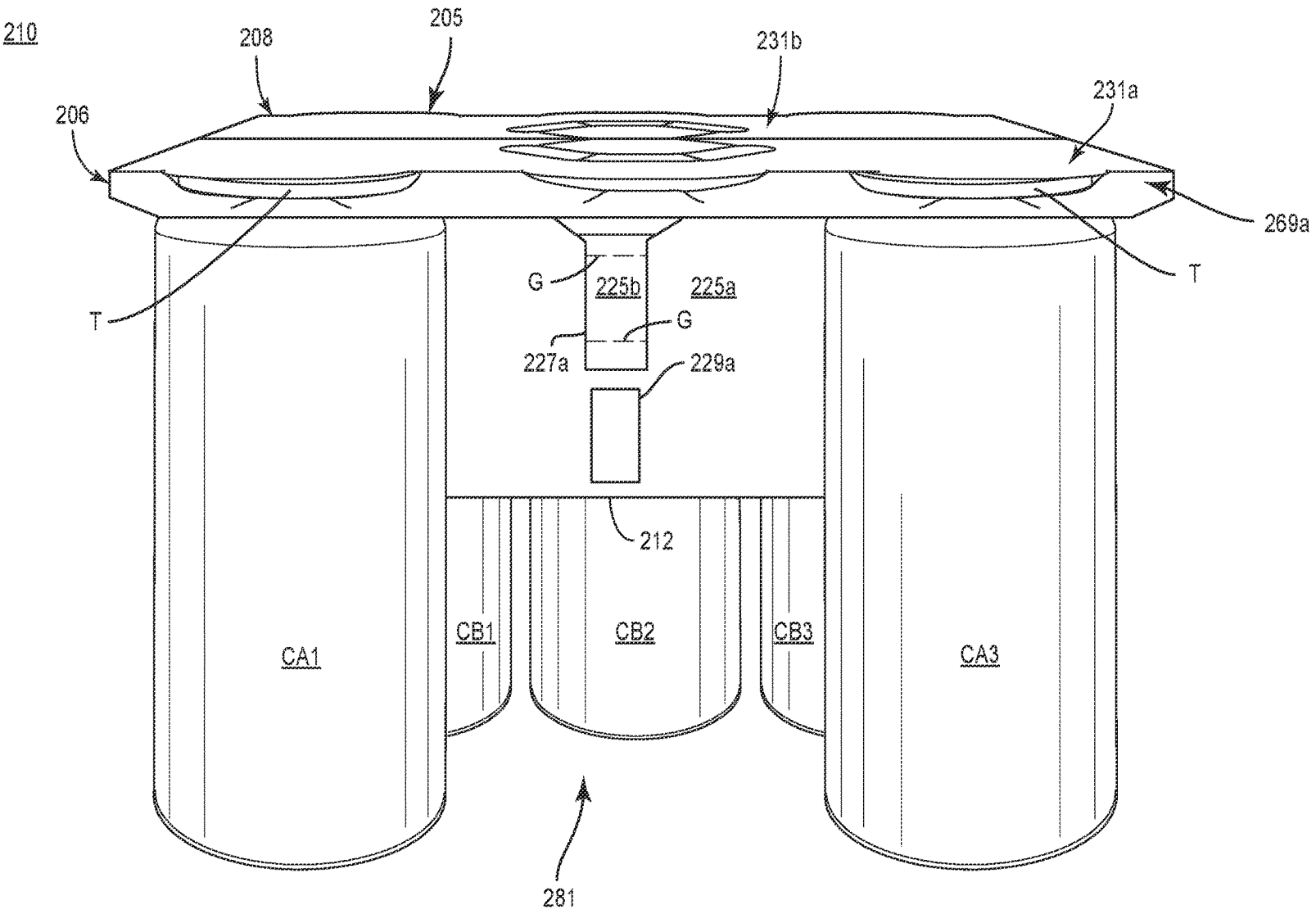
FIG. 8 is a front view of a package and carrier formed from the blank of FIG. 6 in a first configuration and having a pair of containers removed according to the second exemplary embodiment.
Figure 9:
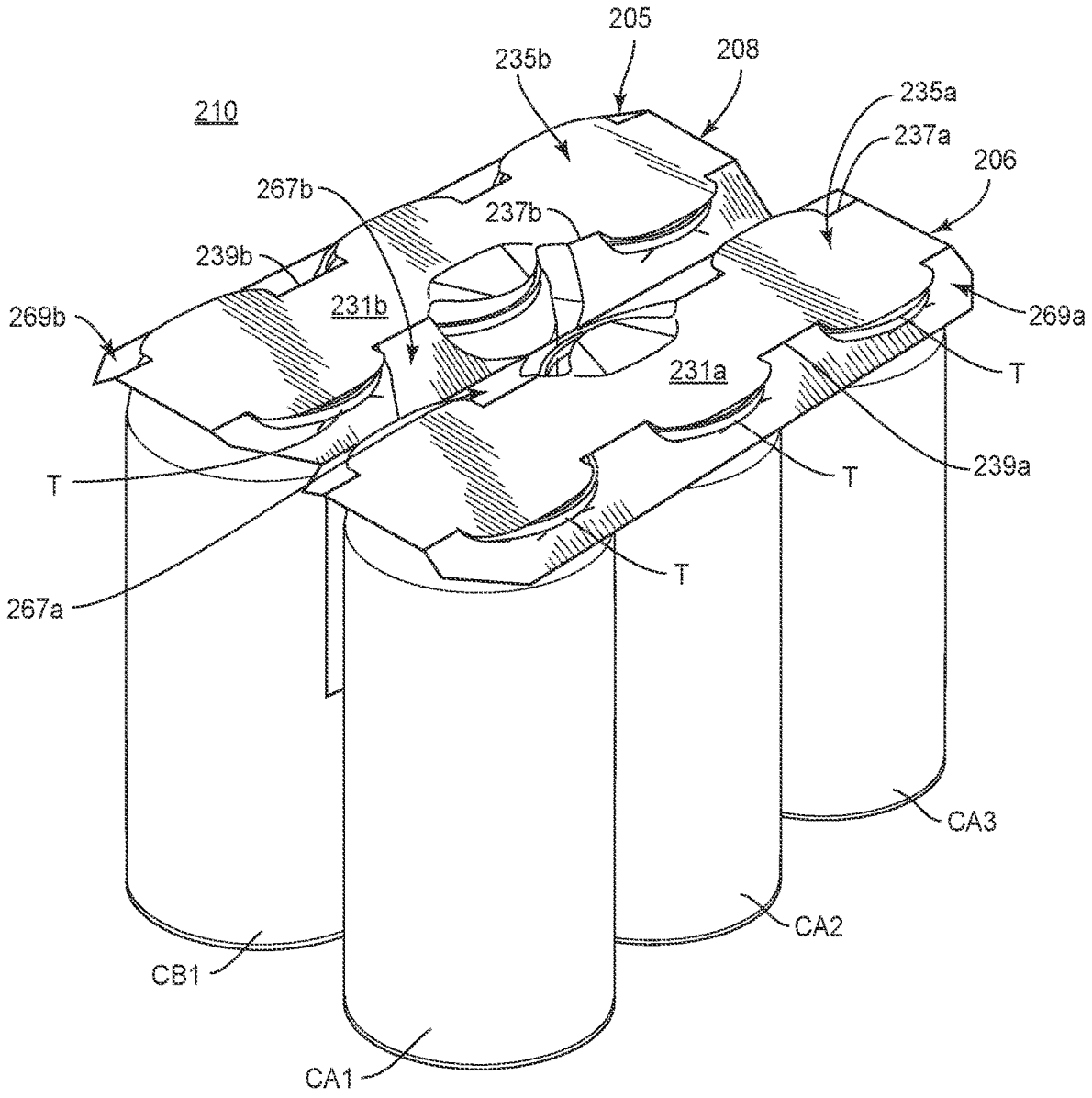
FIG. 9 is a perspective view of the package and carrier of FIG. 8 including the removed pair of containers.

In one embodiment, referring additionally to FIGS. 7-9 (and noting that the glue G has been omitted from FIG. 7 for clarity of illustration), the interior surface or underside of the front attachment panel 231*a* and the back attachment panel 231*b* can be placed over a top portion T of the respective containers CAL CA2, CA3 and CB1, CB2, CB3, such that the top portions T of the respective containers CAL CA2, CA3 and CM, CB2, CB3 are received through the respective cuts 241*a*, 241*b* to be at least partially engaged by adjacent edges of the respective attachment panels 231*a*, 231*b*, the respective interior marginal portions 267*a*, 267*b* and the respective retention flaps or exterior marginal portions 269*a*, 269*b*. In addition, the respective interior marginal portions 267*a*, 267*b* and the respective exterior marginal portions 269*a*, 269*b* can be urged or otherwise folded downwardly at the respective fold lines 237*a*, 237*b*, 239*a*, 239*b* to be arranged obliquely relative to the respective container retention portions 235*a*, 235*b* of the respective attachment panels 231*a*, 231*b*.

In this regard, the respective retention tabs 277*a*, 277*b* can at least partially separate from the respective interior marginal portions 267*a*, 267*b* and respective exterior marginal portions 269*a*, 269*b*. In such an arrangement, the respective containers CAL CA2, CA3, CB1, CB2, CB3 are at least partially retained between a respective retention tab 277*a*, 277*b* and a respective marginal portion 267*a*, 269*a* and 267*b*, 269*b*. In one embodiment, one or more of the retention tabs 277*a*, 277*b* can engage a portion of a respective container CAL CA2, CA3, CB1, CB2, CB3, e.g., a recessed portion of a respective top adjacent a container rim.

The front central panel 225*a* and the back central panel 225*b* can be folded at the fold line 212 and the central panels 225*a*, 225*b* can be moved into at least partial face-to-face contact in the direction of the respective arrows A5, A6 such that the front central panel 225*a* and the back central panel 225*b* are in at least partial face-to-face contact and such that the respective glue openings 227*a*, 227*b* and the respective surface features 229*a*, 229*b* in the respective central panels 225*a*, 225*b* are positioned in general alignment so as to be laterally aligned but longitudinally offset due to the different relative spacing of the respective glue openings 227*a*, 227*b* away from the centerline CL.

In this regard, the central panels 225*a*, 225*b* are arranged such that a portion of the front central panel 225*a* overlaps each of the glue openings 227*b* and a portion of the back central panel 225*b* overlaps each of the glue openings 227*a* to provide respective surfaces upon which the respective containers CA1, CA2, CA3, CB1, CB2, CB3 can be adhered or otherwise attached, as described further herein. For example, glue G can be aligned with the glue openings 227*a* to provide an adhesion surface on a respective portion of the back central panel 225*b*, and glue G can be aligned with the glue openings 227*b* to provide adhesion surfaces on respective portions of the front central panel 225*a*. The glue G can cover at least a portion of the surface features 229*a*, 229*b* such that one or more of the surface features 229*a*, 229*b* presents additional surfaces for adhesion and/or spacing between the front portion 206 and the back portion 208 of the carrier 205.

The attachment of the containers CA1, CA2, CA3, CB1, CB2, CB3 to the respective central panels 225*a*, 225*b* can provide retention and support of the respective containers, e.g., such that the containers do not detach from the carrier 205 under their own weight, in addition to or alternative to the container retention and support provided by the respective container retention portions 235*a*, 235*b*. For example, in one embodiment, one or more of the containers CA1, CA2, CA3, CB1, CB2, CB3 can be attached to a respective central panel 225*a*, 225*b* with glue G, without additional retention and support provided by a container retention portion as described above, and as discussed further below.

Such enhanced attachment of the respective containers to the respective central panels 225*a*, 225*b* with the glue G can also provide enhanced integrity to the carrier 205, e.g., by providing opposing adhesive forces on the respective central panels 225*a*, 225*b* such that the central panels 225*a*, 225*b* are compressed therebetween. For example, in one embodiment, if the carrier 205 is lifted, the containers CA1, CA2, CA3 can at least partially pull the portions of the back central panel 225*b* to which they are attached through the respective glue openings 227*a* toward the front central panel 225*a* under the at least partial weight of the containers CA1, CA2, CA3. Respective portions of the front central panel 225*a* can be pulled toward the back central panel 225*b* through the respective glue openings 227*b* by the containers CB1, CB2, CB3 in a similar manner.

Accordingly, the attachment panels 247*a*, 247*b* are positionable relative to the respective central panels 125*a*, 125*b* such that in a first configuration of the carrier 205, e.g., a storage and/or transport configuration of the carrier 205, the respective attachment panels 231*a*, 231*b* are in a first position to overlie and receive a portion of the respective containers CA1, CA2, CA3 and CB1, CB2, CB3 that extend therebelow. In such an arrangement, containers CA1, CA2, CA3 extend below the container retention portion 235*a* in the front portion 206 of the carrier 205, and containers CB1, CB2, CB3 extend below the container retention portion 235*b* in the back portion 208 of the carrier 205.

Figure 10:
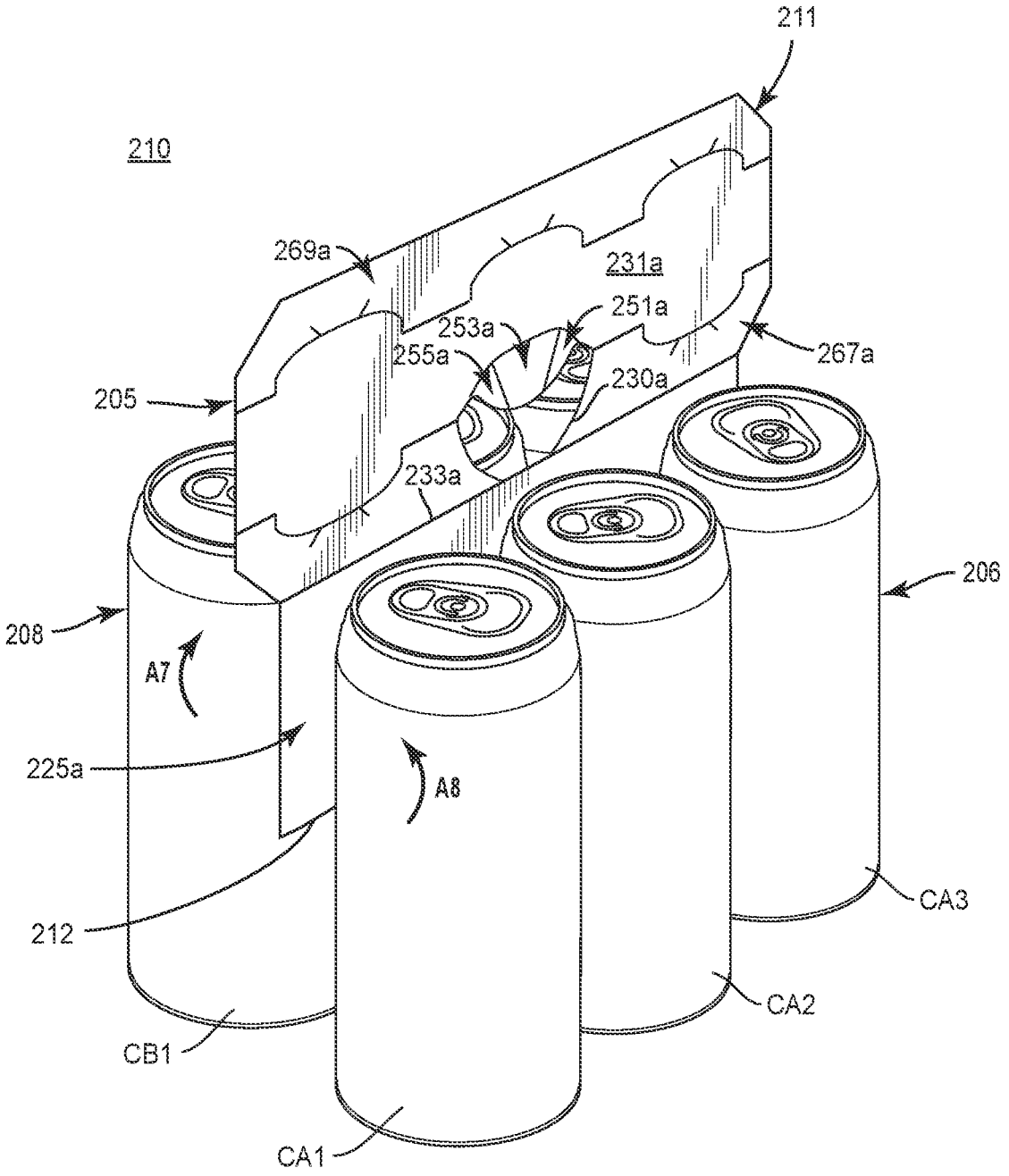
FIG. 10 is a perspective view of the package and carrier of FIG. 9 in a second configuration.

Referring additionally to FIG. 10, in a second configuration of the carrier 205, e.g., a carrying configuration of the carrier 205 (FIGS. 18-20), the attachment panels 231*a*, 231*b* can be detached from the respective containers CA1, CA2, CA3 and CB1, CB2, CB3, and the attachment panels 231*a*, 231*b* can be repositioned relative to the respective central panels 225*a*, 225*b* by folding the attachment panels 231*a*, 231*b* upwardly at the respective fold lines 233*a*, 233*b* in the direction of the respective arrows A6, A7 into at least partial face-to-face or otherwise overlapping contact and such that the handle openings 230*a*, 230*b* are generally aligned. Such upright arrangement of the attachment panels 231*a*, 231*b* (broadly, "second position" of the attachment panels 231*a*, 231*b*) provides a handle 211 that a customer can grasp, for example, through the handle openings 230*a*, 230*b*. One or more of the handle reinforcement flaps 251*a*, 253*a*, 255*a*, 251*b*, 253*b*, 255*b* can be at least partially folded at respective portions of the respective fold lines 256*a*, 256*b* into at least partially overlapping relation with a respective attachment panel 231, 231*b*, for example, to provide a layered structure that provides additional carrying strength and/or comfort. It will be understood that the carrier 205 can be selectively reconfigured between the first configuration and the second configuration to accommodate a desired application of the carrier 205.

The package 210 described above provides a carrier 205 with a compact structure that can, for example, provide materials savings and waste reduction. Additionally, the arrangement of the glue G among the containers CA1, CA2, CA3, CB1, CB2, CB3 and the respective central panels 225*a*, 225*b* provides multiple points of attachment that results in a robust structure for holding and carrying the containers CA1, CA2, CA3, CB1, CB2, CB3. Further, the exposure of one or more portions of the containers CA1, CA2, CA3, CB1, CB2, CB3 on exterior portions of the carrier 205/package 210 provides a customer with a clear view of labeling or surface graphics associated with the containers CA1, CA2, CA3, CB1, CB2, CB3, as well as providing convenient access to remove one or more of the containers CA1, CA2, CA3, CB1, CB2, CB3 from the carrier 205/package 210, for example, by peeling a respective container away from an adjacent or portion of the carrier 205 and/or an adjacent container.

Peeling or pulling the containers CA1, CA2, CA3, CB1, CB2, CB3 away from a respective central panel 225*a*, 225*b* can involve pulling the respective container with a force sufficient to overcome the adhesive bond of the respective container and the respective central panel 225*a*, 225*b* provided by the glue G. In one embodiment, the glue G can be selected so as to remain on a respective central panel 225*a*, 225*b*, e.g., such that substantially little or no glue G remains on the container as it is removed. One or more of the containers CA1, CA2, CA3, CB1, CB2, CB3, in one embodiment, can be reattached to a respective central panel 225*a*, 225*b* following therefrom by pressing the container against a respective region of glue G.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising at least one central panel and at least one attachment panel for receiving a portion of one or more containers of the plurality of containers, the at least one central panel is for being positioned between adjacent containers of the plurality of containers, the at least one attachment panel is foldably connected to the at least one central panel; and at least one divider flap foldably connected to the at least one central panel;

the at least one attachment panel is positionable between a first position and a second position, in the first position the at least one attachment panel overlies and receives a portion of one or more of the containers such that the at least one attachment panel is attached to one or more containers of the plurality of containers, and in the second position the at least one attachment panel is detached from the plurality of containers and folded relative to the at least one central panel and in an upright position with the at least one attachment panel configured as a handle panel to form a handle for carrying the carrier.

2. The carrier of claim 1, wherein the at least one central panel is a front central panel, the carrier further comprises a back central panel in at least partial face-to-face contact with the front central panel, the attachment panel is a front attachment panel, and the carrier further comprises a back attachment panel.

3. The carrier of claim 2, wherein each of the front central panel and the back central panel comprises a respective glue opening, and the respective glue openings are longitudinally offset.

4. The carrier of claim 2, wherein each of the front central panel and the back central panel comprises a respective glue opening, and the respective glue openings are aligned such that a front portion of the carrier and a back portion of the carrier are in communication through the aligned glue openings.

5. The carrier of claim 1, wherein the at least one divider flap defines a first container receiving space and a second container receiving space adjacent the first container receiving space.

6. The carrier of claim 5, wherein the at least one divider flap comprises a glue opening with the first container receiving space and the second container receiving space in communication through the glue opening.

7. The carrier of claim 2, wherein the at least one divider flap comprises a front divider flap foldably connected to the front central panel and a back divider flap foldably connected to the back central panel.

8. The carrier of claim 7, wherein the front divider flap defines at least a first container receiving space in the front portion of the carrier and the back divider flap defines a second container receiving space in the back portion of the carrier.

9. A blank for forming a carrier for holding a plurality of containers, the blank comprising:

a plurality of panels comprising at least one central panel and at least one attachment panel for receiving a portion of one or more containers of the plurality of containers, the at least one attachment panel is foldably connected to the at least one central panel, the at least one central panel is for being positioned between adjacent containers of the plurality of containers when the carrier is formed from the blank; and at least one divider flap foldably connected to the at least one central panel;

the at least one attachment panel is positionable between a first position and a second position, in the first position the at least one attachment panel overlies and receives a portion of one or more of the containers such that the at least one attachment panel is attached to one or more containers of the plurality of containers when the carrier is formed from the blank, and in the second position the at least one attachment panel is detached from the plurality of containers and folded relative to the at least one central panel and in an upright position with the at least one attachment panel configured as a handle panel to form a handle for carrying the carrier formed from the blank.

10. The blank of claim 9, wherein the at least one central panel is a front central panel, the blank further comprises a back central panel for being positioned in at least partial face-to-face contact with the front central panel when the carrier is formed from the blank, the attachment panel is a front attachment panel, and the blank further comprises a back attachment panel.

11. The blank of claim 10, wherein each of the front central panel and the back central panel comprises a respective glue opening, and the respective glue openings are positioned to be longitudinally offset when the carrier is formed from the blank.

12. The blank of claim 10, wherein each of the front central panel and the back central panel comprises a respective glue opening, and the respective glue openings are positioned to be aligned when the carrier is formed from the blank.

13. The blank of claim 10, wherein the at least one divider flap comprises a front divider flap foldably connected to the front central panel and a back divider flap foldably connected to the back central panel.

14. The blank of claim 13, wherein the front divider flap defines at least a first container receiving space in the front portion of the carrier formed from the blank and the back divider flap defines a second container receiving space in the back portion of the carrier formed from the blank.

15. The blank of claim 9, wherein the at least one divider flap defines a first container receiving space and a second container receiving space adjacent the first container receiving space in the carrier formed from the blank.

16. The blank of claim 15, wherein the at least one divider flap comprises a glue opening and the first container receiving space and the second container receiving being in communication through the glue opening in the carrier formed from the blank.

17. A method of forming a carrier for holding a plurality of containers, the method comprising:

obtaining a blank comprising a plurality of panels comprising at least one central panel and at least one attachment panel for receiving a portion of one or more containers of the plurality of containers, the at least one attachment panel is foldably connected to the at least one central panel, the blank comprises at least one divider flap foldably connected to the at least one central panel;

positioning the at least one central panel between adjacent containers of the plurality of containers;

positioning the at least one attachment panel in a first position in which the at least one attachment panel overlies and receives a portion of one or more of the containers such that the at least one attachment panel is attached to one or more containers of the plurality of containers; and positioning the at least one attachment panel in a second position in which the at least one attachment panel is detached from the plurality of containers and folded relative to the at least one central panel and in an upright position with the at least one attachment panel configured as a handle panel to form a handle for carrying the carrier.

18. The method of claim 17, wherein the at least one central panel is a front central panel, the carrier further comprises a back central panel in at least partial face-to-face contact with the front central panel, the attachment panel is a front attachment panel, and the carrier further comprises a back attachment panel.

19. The method of claim 18, wherein each of the front central panel and the back central panel comprises a respective glue opening, and the respective glue openings are longitudinally offset.

20. The method of claim 18, wherein each of the front central panel and the back central panel comprises a respective glue opening, and the respective glue openings are aligned such that a front portion of the carrier and a back portion of the carrier are in communication through the aligned glue openings.

21. The method of claim 18, wherein the at least one divider flap comprises a front divider flap foldably connected to the front central panel and a back divider flap foldably connected to the back central panel.

22. The method of claim 21, further comprising positioning the front divider flap to define at least a first container receiving space in the front portion of the carrier and positioning the back divider flap to define a second container receiving space in the back portion of the carrier.

23. The method of claim 17, further comprising positioning the at least one divider flap to define a first container receiving space and a second container receiving space adjacent the first container receiving space.

24. The method of claim 23, wherein the at least one divider flap comprises a glue opening and the first container receiving space and the second container receiving space are in communication through the glue opening.

25. A package, comprising:

a plurality of containers; and a carrier comprising:

a plurality of panels comprising at least one central panel and at least one attachment panel receiving a portion of one or more containers of the plurality of containers, the at least one central panel is positioned between adjacent containers of the plurality of containers, the at least one attachment panel is foldably connected to the at least one central panel, the carrier comprises at least one divider flap foldably connected to the at least one central panel;

the at least one attachment panel is positionable between a first position and a second position, in the first position the at least one attachment panel overlies and receives a portion of one or more of the containers such that the at least one attachment panel is attached to one or more containers of the plurality of containers, and in the second position the at least one attachment panel is detached from the plurality of containers and folded relative to the at least one central panel and in an upright position with the at least one attachment panel configured as a handle panel to form a handle for carrying the package.

26. The package of claim 25, wherein the at least one central panel is a front central panel, the carrier further comprises a back central panel in at least partial face-to-face contact with the front central panel, the attachment panel is a front attachment panel, and the carrier further comprises a back attachment panel.

27. The package of claim 26, wherein each of the front central panel and the back central panel comprises a respective glue opening, and the respective glue openings are longitudinally offset.

28. The package of claim 26, wherein each of the front central panel and the back central panel comprises a respective glue opening, and the respective glue openings are aligned such that a front portion of the carrier and a back portion of the carrier are in communication through the aligned glue openings.

29. The package of claim 26, wherein the at least one divider flap comprises a front divider flap foldably connected to the front central panel and a back divider flap foldably connected to the back central panel.

30. The package of claim 29, wherein the front divider flap defines at least a first container receiving space in the front portion of the carrier and the back divider flap defines a second container receiving space in the back portion of the carrier.

31. The package of claim 25, wherein the at least one divider flap defines a first container receiving space and a second container receiving space adjacent the first container receiving space.

32. The package of claim 31, wherein the at least one divider flap comprises a glue opening and the first container receiving space and the second container receiving space are in communication through the glue opening.

* * * * *